United States Patent [19]

Maehashi

[11] Patent Number: 4,620,725

[45] Date of Patent: Nov. 4, 1986

[54] FORMS SUCH AS A NOTEBOOK AND THE LIKE

[76] Inventor: Kiyoshi Maehashi, 18-32 Jurinji-minamimachi, Nishinomiya-shi, Hyogo-ken, Japan

[21] Appl. No.: 590,340

[22] Filed: Mar. 16, 1984

[30] Foreign Application Priority Data

| | | | |
|---|---|---|---|
| Apr. 4, 1983 | [JP] | Japan | 5450016 |
| Apr. 26, 1983 | [JP] | Japan | 58/63458 |
| Apr. 26, 1983 | [JP] | Japan | 58/63459 |

[51] Int. Cl.[4] ..... B42D 3/02; B42D 3/00; B42F 11/04; H01F 1/16

[52] U.S. Cl. ..... 281/45; 281/31; 402/503; 148/105

[58] Field of Search ..... 281/5, 27, 31, 45; 148/103, 104, 105; 446/137; 282/11.5 R; 402/503, 505

[56] References Cited

U.S. PATENT DOCUMENTS

| | | | |
|---|---|---|---|
| 715,162 | 12/1902 | Schwartz | 281/2 |
| 1,968,430 | 7/1934 | Tanner | 281/27 |
| 2,458,729 | 1/1949 | Politzer | 281/5 |
| 3,021,156 | 2/1962 | Coillot | 281/31 |
| 3,330,581 | 7/1967 | Ivarsson-Wallerstrom | 281/5 |
| 3,856,582 | 12/1974 | Smeggil et al. | 148/105 |
| 3,929,519 | 12/1975 | Benz | 148/105 |
| 4,054,530 | 10/1977 | Deffeyes | 148/105 |

FOREIGN PATENT DOCUMENTS

| | | | |
|---|---|---|---|
| 2245760 | 3/1974 | Fed. Rep. of Germany | 281/45 |
| 975836 | 3/1951 | France | 282/11.5 R |
| 631466 | 11/1949 | United Kingdom | 402/503 |

*Primary Examiner*—Paul A. Bell
*Assistant Examiner*—Paul M. Heyrana, Sr.
*Attorney, Agent, or Firm*—Moonray Kojima

[57] ABSTRACT

A forms set comprising a pair of covers and a set of blanks held therebetween. One or both of the covers have magnetic material therein which is magnetized so that the covers are held closed by the magnetic attraction therebetween. Also, one or both of the external surfaces of the set of blanks has a portion thereof made of magnetic material which is magnetically attracted by the one or more magnetized covers. The non-magnetic portion of the external surfaces enables the magnetic force to travel between the covers. In an alternative embodiment, the external surface is placed in a pouch disposed in the inside of the cover. The magnetic holding of the covers enables easy replacement of the set of blanks or one or more of the blanks therein.

3 Claims, 7 Drawing Figures

FORMS SUCH AS A NOTEBOOK AND THE LIKE

BACKGROUND OF THE INVENTION

1. Field of the Invention

The present invention relates to forms such as a notebook, a diary, or a memorandum book.

2. Disclosure of the Prior Art

With regard to such a field as a notebook having folded paper in a zig zag format, conventionally, it was disclosed that both of the front and back covers of the notebook are formed of a magnetized ferromagnetic substance. In that case, however, although the magnetic attraction between the front and back covers by the magnetic force makes it possible to keep the state in which the covers are binded, the cover and the notebook proper, which are fixed to each other by means of adhesion, etc., cannot be flexibly replaced with new ones. Similarly, in a binded-type of book, the binding margin of which is adhered to the hinging part of the cover so that such a margin may be fixed thereto, and hence also cannot be replaced with a new one.

SUMMARY OF THE INVENTION

The purpose of the present invention is to provide forms (or sets of blanks) such as the notebook and the memorandum book in which the forms proper, located inside of the covers, are attracted to the internal surface of both covers by the magnetic force so that the forms are fixed between the covers at the same time the front cover to the back cover by the magnetic force thereby to fix their position.

Another purpose of the present invention is to provide the forms such as the notebook and the memorandum book, magnetically attracted to fix their positions, in which the forms proper may be removed from the cover, whereby making it possible to replace old forms with new ones.

Still another purpose of the present invention is to provide magnetic positioning of the front cover to the back cover which is performed by means of transmitting the magnetic force through the paper area excluding the central section provided on the external surface of the forms proper or the magnetic substance located on the peripheral frame section thereof.

Still further purpose of the present invention is to provide the forms such as the notebook, which are convenient to handle, and in which the notebook or memorandum set is fixed to the cover by means of inserting at least one outermost sheet of the forms proper into a bag provided on the internal surface of the cover, whereby the forms proper are readily replaceable.

The present invention, in order to attain the foregoing purposes, is concerned with the arrangement in which the attracted surface on which the forms proper and one cover are fixed to each other is reduced to either the peripheral section or the central section. The magnetic fixing of the rest of the forms proper to another corresponding cover is also realized, by the attracted section comprising extremely thin magnetic substance such as steel foil on the central section or the peripheral section of one external surface of the forms proper, such as including the notebook folding up the paper zigzag, the book binding its one edge side or the memorandum book piling a plurality of papers is provided. The front cover, comprising magnetized ferromagnet substance, is faced to the above-mentioned attracted section of the forms so that said cover is attracted thereto, and, at the same time, the back cover is adapted to be attractedly fixed to another external surface of the forms by means of transmitting the magnetic force through the paper surface located on the area including the peripheral section without the attracted section or the central section.

For this reason, the forms, such as the notebook and the like, have on external surface possessing the extremely thin magnetic substance, such as the steel foil, combined with one cover by means of attraction said external surface thereof to said cover. At that time, since the extremely thin magnetic substance plays a role as a yoke for concentrating the distributed magnetism on the cover, when the steel of high permeability is selected as the material of the cover which is attracted to another external surface of the forms proper, so far as the section possessing the extremely thin magnetic substance is concerned, the magnetism on the cover does not reach the corresponding cover which is faced thereto, whereby the attracted force between these covers hardly takes place. Nevertheless, the section without the extremely thin magnetic substance adapts the magnetism on one cover to be transmitted through the forms proper and said magnetism reaches another cover, whereby the adequate attracted action is produced.

On the other hand, while one cover comprises the magentized ferromagnet substance, another cover comprises the same magnetized ferromagnet substance or the steel of high permeability, and at least one of both the external covers has its internal surface provided with the bag which can detachably fixed to one sheet of the outermost surface of the above-mentioned forms thereto in an insertive manner.

Under the foregoing formation, fixing the cover, having the bag, to the forms proper is done by inserting detachably one sheet of the outermost surface of the forms proper through the bag. The front and back covers are attracted to each other by their mutual magnetic force, namely the magnetism on one cover reaches the other cover through the forms proper, thereby producing the attracted action.

DETAILED DESCRIPTION OF PREFERRED EMBODIMENT

Figure 1:
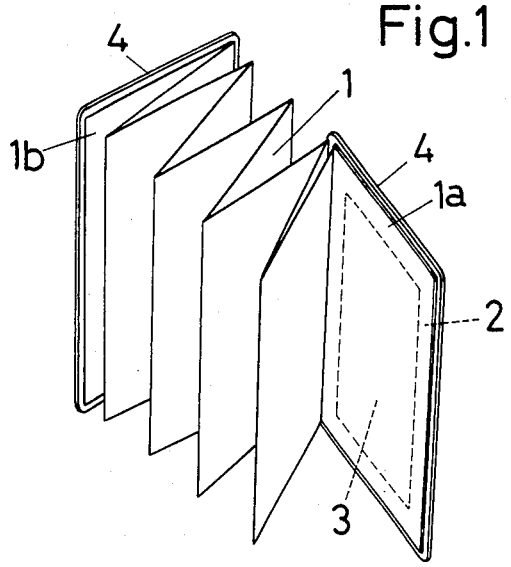
FIG. 1 is a perspective view of the notebook, which is partially opened, illustrating one embodiment according to the present invention.

Referring firstly to FIG. 1, 1 is forms proper of the notebook being folded up zigzag manner and 1 a and 1 b are both the outermost surfaces of the forms proper. 2 is the frame of steel plate as thin as a paper, which, serves as the extremely thin magnetic substance provided on the periphery of external surface 1 a, and is approximately 30–120 micro meter thick and its surface is laminated with the paper.

Figure 2:
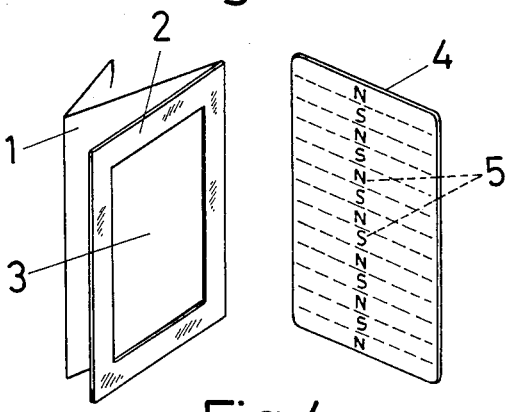
FIG. 2 is a perspective view illustrating separately the cover and the forms proper.

The covers are in one embodiment both magnetized in opposite polarites so as to be mutually magnetically attracted. In another embodiment, only one is magnetized with the other cover having magnetic material so that the magnetized cover will attract the other cover. Such a surface may be sometimes applied with a decorative surface made of synthetic paper, vinyl chloride, etc. In FIG. 2 a O-shaped is provided around the periphery of the external surface 2 of forms 1 and the central section 3 is taken out to be hollow. 4 is the cover which is molded to have the size of the cover of the notebook, and is formed of a ferrite powder into flexible synthetic resin plate serving as the material for said cover and dotted lines 5 indicate the state of being magnetized.

After molding, the cover 4 is magnetized An anisotropic magnet (substance in which ferrite crystals are arranged in parallel in synthetic resin plate and when being magnetized, the constant magnetic force takes place perpendicularly to the surface thereof.) or an isotropic magnet (substance in which, due to the uneven arrangement of the ferrite crystals, the directions of the magnetic force are not constant.) can be utilized as the magnet. If the anistropic magnet is employed, because it increases the force of attracting the magnetism, the cover is able to be attracted to the external magnetic substance so that there is the probability of attracting the product by itself such as the notebook to the external wall for a while. The dotted lines 5 between the covers 4 and 4 which are both magnetized make their heteropoles take corresponding interaction, thereby attracting one to another.

Figure 3:
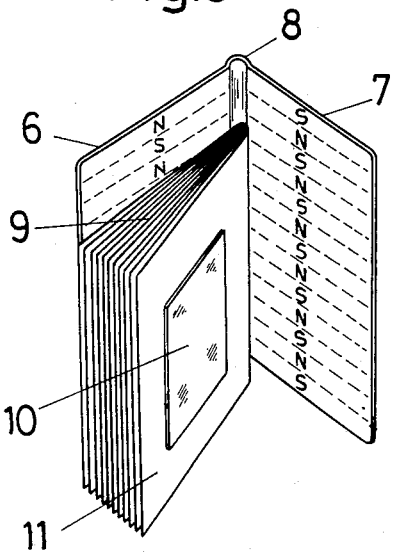
FIG. 3 is a perspective view illustrating another embodiment.

With regard to FIG. 3, which illustrates another embodiment, 6 and 7 are the front and back covers, which are united as one unit by means of the hinging section 8. 9 is the book proper (i.e. set of blanks) and having one side edge thereof bound together. 10 is the extremely thin magentic substance provided on the central sections on both the external surfaces of the set of blanks, and 11 is the periphery having no magnetic material. The drawing shows the notebook separated from the cover. The extremely thin magnetic substance 10 is magnetically attracted to the magnetized surface of the cover 7. Covers 6, 7 are attracted to each other through the periphery 11 (having no magnetic material) and fixed in position with respect to each other. The extremely thin magnetic substance 10, provided on the center, is shown to be a rectangular for illustrative purpose only. Other variants such as a circular shape, rhombic shape, etc. may be used. In this connection, all the requirements to be met lie in the availability of the magnetically attracted force strong enough to attract and hold the forms proper and of maintaining the state of binding the covers in such a manner that they are attracted one to another on the periphery. Under the present embodiment even when one cover falls off, while keeping another cover and when the notebook falls off by mistake, since the other cover can be separated from the book against the attracted force due to its own weight, an accident in which the weight of the cover gives a damage to the book will not take place.

Figure 4:
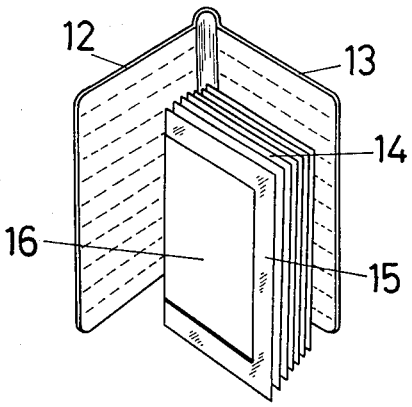
FIG. 4 is a perspective view illustrating further embodiment.

FIG. 4, illustrating still another embodiment, in which 12 and 13 are covers combined by the hinging section as one unit, 14 is plurality of memo paper, and 15 the extremely thin magnetic substance provided on the outermost surface of the memo paper, employing an abridged U-shape outer periphery. The covers 12 and 13 have magnetic surfaces which attract the extremely thin magnetic substances 15 provided on the outermost surfaces of the memo paper and hold the papers in a book format 16 is the central section which does not have any magnetic material thereat.

Under all the foregoing embodiments, since the forms proper are attracted to and held by the internal surface of the cover if they are separated from the cover against the magnetic force, not only an easy separation can be done, but also they are freely replaceable. Also, if the cover is kept the same, the extremely thin magnetic substance used in the forms proper, which is as thin as the paper made of steel, does not become any obstacle, and its weight is not sufficient to be disadvantageous.

Figure 5:
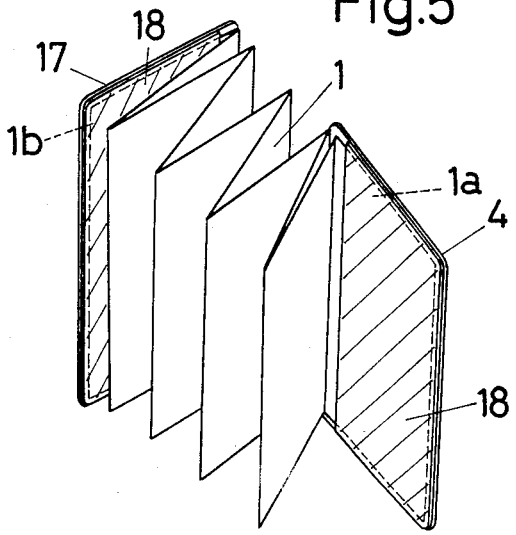
FIG. 5 is a perspective view of the notebook illustrated as still further embodiment.

Referring now to FIG. 5, 1 is forms proper of the notebook having zig zag format formed paper, and 1 a and 1 b are both the outermost surfaces of the main body. 4 is one cover which is molded of the size of the cover of the notebook, and is formed of ferrite powder into the flexible synthetic resin plate serving as the material for the cover, and is magnetized 17 is another cover made of a material of high permeability such as steel, etc. 18 is a bag, made of synthetic resin film, etc., which is provided on each of the external surfaces of the covers 4 and 17. Under the present embodiment the bag 18 is adhered to three-sided edges of the cover 4, the last edge is opened to be formed as an inserting inlet.

Figure 6:
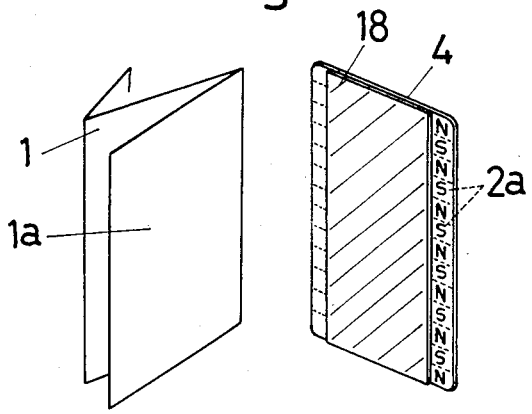
FIG. 6 is a perspective view of FIG. 6.
Figure 7:
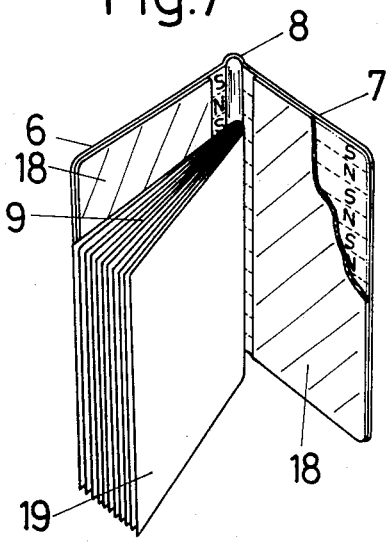
FIG. 7 is a perspective view illustrating still further embodiment.

The outer sheets of the set of blanks may be inserted in the bags or pouches disposed on the inside of the cover to hold the set of blanks to the cover FIG. 6 illustrates another embodiment of the bag 18, which takes a shape being adhered only to two short sides of the peripheral sides of the cover. In any case, it is acceptable even if only one sheet of the outermost surface of the forms proper 1 (also called set of blanks) is of a shape so as to fit into the bag with the outer or exterior surface thereof, as shown.

The notebook folding up the paper zigzag according to the present embodiment has each of the outermost surfaces 1 a binding one-sided edge and 19 is one sheet of the outermost surface of the forms proper. The covers 6 and 7 and the forms proper 9 are shown to constitute the notebook when one sheet of the outermost surface 19 is inserted into the bag 18 so that they may be combined as one unit. Similarly to the above-mentioned embodiment, the attracting action of the front cover to the back cover is produced by the magnetic force taking place through the forms.

With any of all the foregoing embodiments, since the forms proper are only inserted into the bag provided on the cover for their fixation, they can be easy to part from the cover and may be replaced, even if the cover is the same, the bag is not any obstacle because it is extremely thin and does not add any substantial amount of weight.

Since the present invention takes the foregoing formation, as the notebook and the memo paper, the covers, convenient to carry, are formed to be thin in a manner of being attracted one to another and the magnetic force on the cover may ensure the main body such as the notebook and the memo paper to be attracted to each other for holding in position. In addition, since only magentic attraction is employed, even if one cover is removed by a mistake, it may be easily parted from the forms proper due to its own weight, and does not give a damage to the set of blanks. Also, the covers and blanks may be readily replaced with new ones, and the cover, being of semi-permanent use, produces a marked practical effect.

What is claimed is:

1. In a form set comprising a first cover;

a second cover; and a set of blanks connected to each other at one edge thereof and disposed between said first cover and said second cover; the improvement comprising at least one of said covers having an entire surface thereof formed of a magnetized material with the other cover having magnetic material as a substantial part thereof so that in a closed state the two covers are magnetically attracted to each other and held in a position close to each other with said set of blanks therebetween by the magnetic attraction; and said set of blanks connected together at one edge thereof has two external surfaces, at least one of said external surfaces has at least three margin surface areas thereof coated with or having a magnetic material so that when disposed between the two covers the magnetic material part of said external surface will be magnetically attracted to said magnetized cover, and said magnetic attraction holds set of blanks to said cover, and so that the portion of said external surface within said margin surface areas not having any magnetic material coated thereon or therein enables said magnetized cover to magnetically attract the other cover through said non-magnetic material portion of said external surface.

2. The form set of claim 1 wherein both said covers have their entire surfaces magnetized in opposite polarities.

3. The form set of claim 1, wherein both external surfaces have at least three margin surface areas thereof of magnetic material.

* * * * *